United States Patent [19]

Percival

[11] Patent Number: 4,467,926

[45] Date of Patent: Aug. 28, 1984

[54] RACK SUPPLY SYSTEM

[76] Inventor: George Percival, 10 Twain St., Bloomfield, N.J. 07003

[21] Appl. No.: 353,635

[22] Filed: Mar. 1, 1982

[51] Int. Cl.[3] ..... A47F 5/01; A47F 5/08

[52] U.S. Cl. ..... 211/106; 211/94.5; 211/49 D; 248/220.3

[58] Field of Search ..... 211/49 D, 46, 106, 94, 211/162, 87, 57.1, 59.1, 54.1, 94.5; 298/220.3, 221.1, 221.2, 222.2, 220.2; 312/50

[56] References Cited

U.S. PATENT DOCUMENTS

| | | | |
|---|---|---|---|
| 2,484,453 | 10/1949 | Halverson | 211/94 X |
| 2,802,576 | 8/1957 | Kelling | 211/49 D |
| 3,172,539 | 3/1965 | Rulf | 211/59.1 |
| 3,217,893 | 11/1965 | Fleishman | 211/94.5 |
| 3,244,391 | 4/1966 | Brunetto | 211/87 X |
| 4,072,246 | 2/1978 | Paulin | 211/59.1 X |

FOREIGN PATENT DOCUMENTS

| | | | |
|---|---|---|---|
| 1142581 | 1/1963 | Fed. Rep. of Germany | 211/54.1 |
| 2428423 | 2/1980 | France | 211/106 |

*Primary Examiner*—Ramon S. Britts

*Assistant Examiner*—Robert W. Gibson, Jr.

*Attorney, Agent, or Firm*—Gottlieb, Rackman & Reisman

[57] ABSTRACT

A rack supply system is disclosed, which includes a frame adapted to be attached to a vertical wall. From the frame, at least a pair of track members slope downwardly, and each track member defines a downwardly-sloping slot. A hanger is supplied and is adapted to retain an article of merchandise of the "impulse-purchase" type. A group of hangers, each holding an article of merchandise, is located across a pair of track members, and each hanger has a pair of segments which fit into the two slots in a pair of track members. As the bottom-most article, i.e. the forward-most article, on its hanger is removed from a pair of track members, the next-in-line hanger and its article of merchandise slides downwardly to the lower ends of the slots in the track members. "Fresh" articles and their hangers are loaded at the upper ends of the track members. By this means, as an article of merchandise on its hanger is removed by a customer from the lower end of the track members, the next-in-line hanger and its article of merchandise moves into place, to be presented to a customer.

9 Claims, 7 Drawing Figures

10
12
14
16
20
22
24a
30
32
33
34
36'
36''
37
40'
42'
44
46
48
48a
50
50a
S
W
S1
S2
S3
A1
A2
B
6

RACK SUPPLY SYSTEM

The present invention relates to a rack for merchandise, and more specifically relates to a rack supply system including at least a pair of descending track members, and articles of merchandise and their related hangers which slide downwardly from an upper loading position to a lower dispensing position, at which the article is presented to a consumer for his consideration as a purchase.

Racks for articles of merchandise are commonly used in various retail locations, such as retail stores, supermarkets and the like. These racks are intended to present articles of merchandise to customers in a neat and attractive manner, thereby to promote sales. This is important in sales of "impulse items", wherein a customer often purchases a given article without prior planning, but rather does so based upon his viewing of the article as presented to him during his walking about a retail location.

It is an object of the present invention to provide a rack supply system which delivers an article of merchandise to a customer at a retail location, in a manner such that "fresh" articles can be loaded into the rack, while "older" articles of merchandise are presented closer to the customer, with the rack or display always having a "full" look.

It is still a further object of the present invention to provide such a rack supply system, which can be easily loaded by retail store personnel whenever needed, and from which a consumer may remove an article of merchandise in a simple and speedy fashion.

In accordance with the foregoing objects, there is provided a rack supply system, including a frame adapted to be removably attached to a vertical wall, and sloping track members on which articles on hangers can slide downwardly. From time to time, as various articles on hangers are removed from the lower ends of the track members, "fresh" articles of merchandise on hangers are loaded at the upper ends of the track members. Thereby, as articles are removed from the lower ends of the track members, fresh articles of merchandise continue to move downwardly and forwardly. The rack supply system, as described, includes downwardly-sloping slots which are defined by the track members. The hangers are intended to pass through the articles of merchandise so that each hanger can support one article of merchandise or a small group of articles of merchandise. The hangers have hooks at their ends, with each hook fitting into a slot defined by a track member. After a hanger is placed through an article of merchandise, its ends are placed into the slots defined by the track members. Due to the downward slope of the track members, each hanger with its article of merchandise is supported by and can slide down a pair of track members, until it either contacts a lower article of merchandise or the lower-most ends of the track members.

With reference to the drawings, which show a preferred embodiment of the invention here disclosed, FIG. 1 is a perspective view of the rack supply system, showing in full lines a package of socks on a hanger partially descended down the rack, and showing in dot and dash lines, the same package in its terminal, dispensing, forward-most position and revealing the position of the hanger therein;

Figure 1:
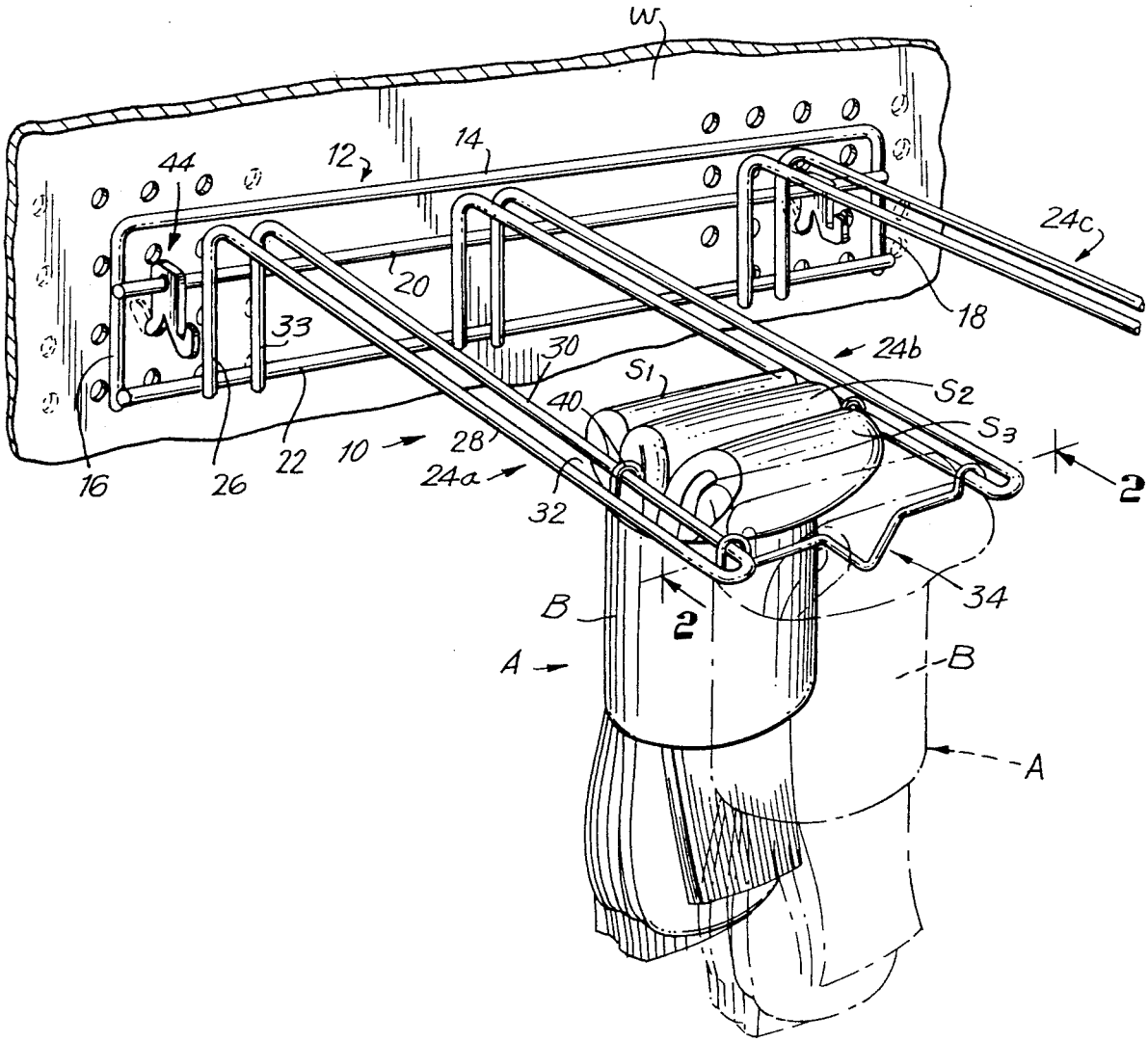

With reference to the drawings, there is shown in FIG. 1, a rack supply system, in accordance with the present invention, generally designated by reference numeral 10. The rack 10 is affixed, in the embodiment shown in the drawings, to a vertical wall in the form of a Peg-Board wall W, that is, a sheet of stiff material such as Masonite, having numerous uniformly-spaced apertures formed in it. However, it will be understood that consistent with the scope of the present invention, the rack 10 can be affixed to any wall having a vertical face, so that the rack is held in its desired upward or vertical orientation.

The rack 10 includes a wire frame 12, the same being the component which is directly attached to and is in contact with the wall W. Furthermore, as will be explained subsequently, it is desirable if the frame 12 is removably attached to the wall W.

The frame 12 desirably includes an upper cross-bar 14 having down-turned end members 16, 18, an intermediate cross-bar 20 and a lower cross-bar 22, all of the bars 14, 20 and 22 being formed of wire stock and being welded into a rectangular configuration. The aforesaid rectangular configuration of the frame 12 enables the rack 10 to be held flush and rigidly against the vertical exterior face of the peg-board wall W.

Fixed to the frame 12 is at least one pair and desirably several pairs of descending track members. In the embodiment shown in the drawings, three identical track members **24*a*, 24*b* and 24*c* are shown as forming two pairs of descending track members; only the track member 24*a* will be described in detail, since the remaining track members are identical. In this embodiment, the track members 24*a* and 24*b* make up one pair or set of track members, and the track members 24*b* and 24*c*** make up a second and parallel set of track members.

Figures 3, 4, 5, 6:
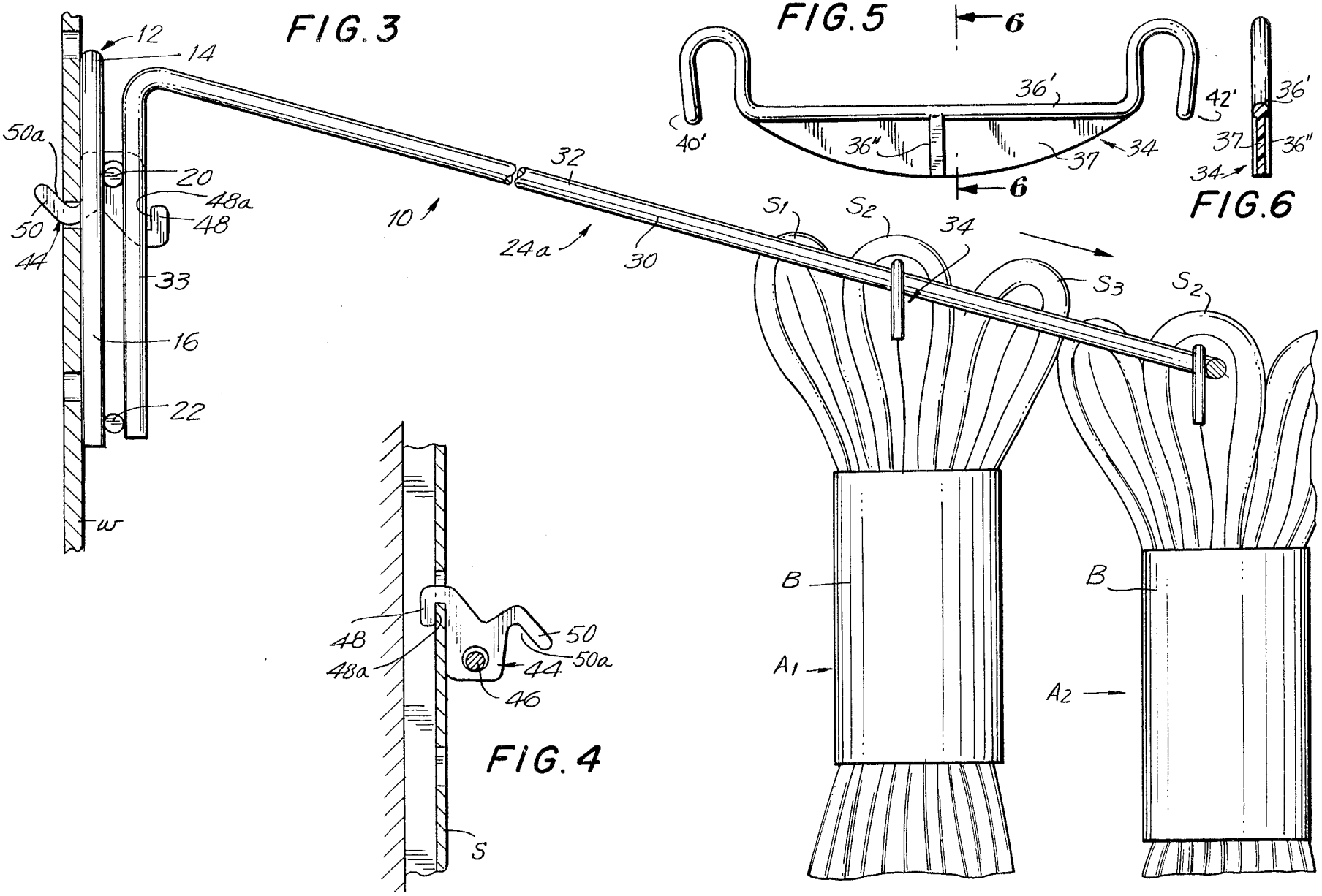
FIG. 3 is a side elevational view of the rack supply means, taken along the line 3—3 of FIG. 2.
FIG. 4 is an enlarged side view of a latch used with the rack, engaged to a vertrical wall structure.
FIG. 5 is a front elevational view of a second form of a hanger.
FIG. 6 is a cross-sectional view thereof taken along the line 6—6 of FIG. 5.

The track member **24*a*, see FIGS. 1 and 3, resembles an "L" shape placed on its side, and constitutes a length of wire stock, doubled upon itself. Other materials may be substituted for this wire stock, such as a rigid plastic. More specifically, the track member 24*a* comprises a first upstanding leg 26, in turn connected to a downwardly-sloped slide 28, connected in turn by a wire bend to a second downardly-sloped slide 30, connected in turn to a second upstanding leg 33. The slides 28, 30 of the track member 24*a* form between them a downwardly-sloped slot 32. The legs 26, 33 are welded to the cross-bars of the frame. As will best be seen in FIG. 3, the included angle between the downwardly-sloping slides 28, 30 and the legs 26, 33** is in the range of 70°. The specific angle may change as a function of the weight of the articles that are placed on the hangers.

Figure 2:
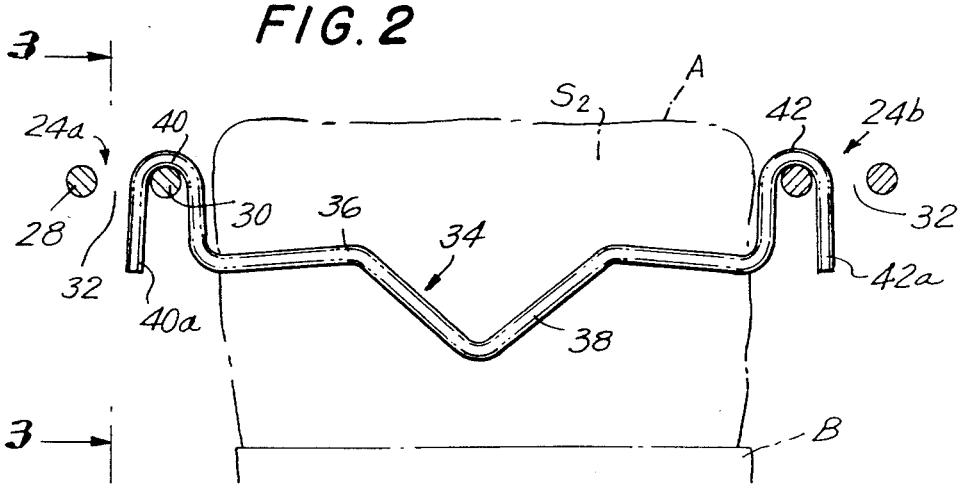
FIG. 2 is a cross-sectional view of the rack supply means, taken generally along the line 2—2 of FIG. 1.

A hanger 34 is a component of the rack 10 and is shown most clearly in one form in FIGS. 1 and 2. The hanger 34, in this form, comprises a cross bar 36 having a central "V"-shaped segment 38, and a pair of downwardly-opening end hooks 40, 42, terminating in exterior segments **40*a*, 42*a*, respectively. As will be seen from FIGS. 1 and 2, the hanger 34 is oriented so that the exterior segments 40***a*, 42*a* of the end hooks 40, 42 fit into the slots 32 defined by the track members 24*a*, 24*b*, the hanger therefore being supported by such members. Furthermore, in a desired form of the present invention, the end hooks 40, 42 are configured with respect to the slots 32, so that one hanger 34 may be retained in the pair of track members 24*a*, 24*b* and a different hanger may be retained in the pair of track members 24*b*, 24*c*, without these end hooks of the different hangers interfering with one another, as the hangers descend on the track members.

Figure 7:
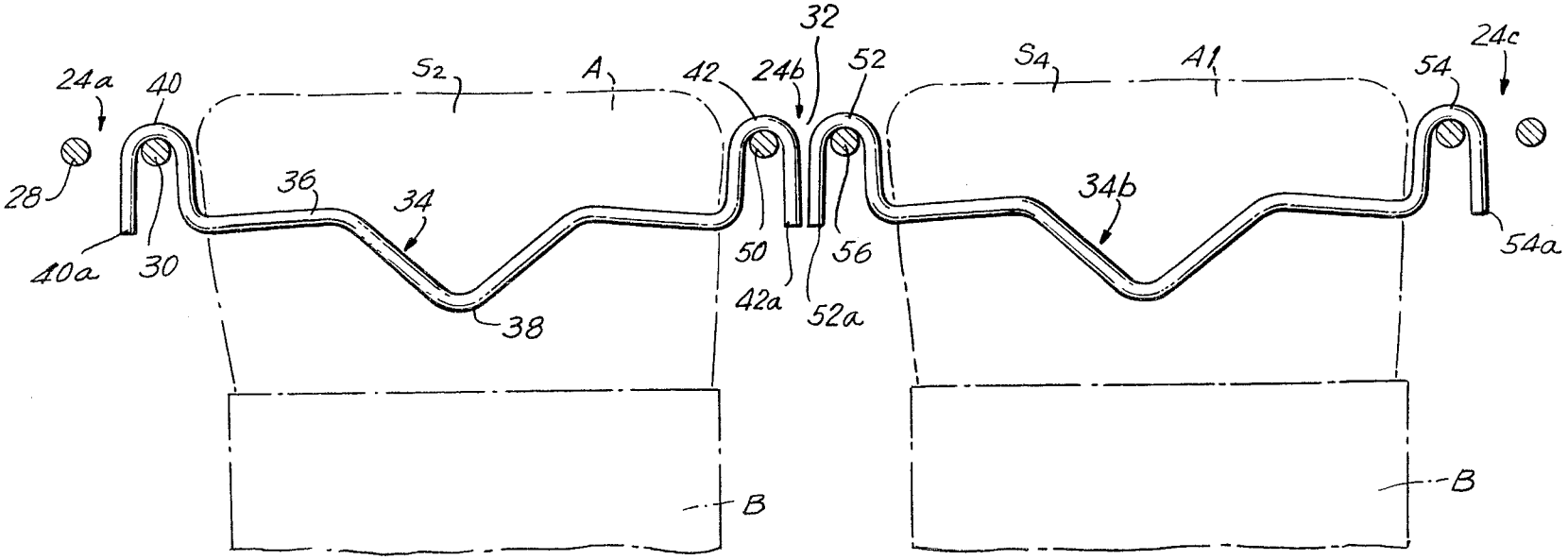
FIG. 7 is a view similar to FIG. 2, showing a pair of side-by-side articles on their hangers, on parallel tracks.

Each hanger 34 is adapted to retain in hanging fashion, an article of merchandise of the type that might be made available for sale in a department store, supermarket or like retail location. In the form shown in the drawings, this retail article A comprises three pairs of socks S1, S2 and S3. Each pair of socks is folded and the pairs of socks are held together by a paper band B. The hanger 34 is slipped through the fold of the central sock S2, so that the group of socks, that is, the article A, is held aloft by the hanger 34 on the track members 24*a*, 24*b*. Since the hanger 34 is supported at both of its ends, it can in turn hold heavy articles of merchandise without fear that the hanger may break. FIG. 7 shows the configuration of the rack supply system, whereby articles of merchandise such as multiple pairs of socks held on their respective hangers, can slide side-by-side along parallel, adjacent track members, without interference with one another in their sliding movement. As referred to previously, the retail article A comprises three pairs of socks S1, S2 and S3. Since FIG. 2 and FIG. 7 are cross-sectional views, only sock S2 is seen in FIG. 7, on the left hand side portion thereof. Article A is supported by hanger 34, whose end hooks 40, 42 ride on slide 30 and slide 50 of track members 24*a*, 24*b*, respectively. On the right hand side portion of FIG. 7 is shown an additional article A1 made up of a number of socks, including sock S4. Article A1 is supported by hanger 34*b*, which includes end hooks 52, 54, which have tips or exterior segments 52*a*, 54*a* respectively. As will be seen in the central portion of FIG. 7, exterior segment 42*a* of hook 42 slopes substantially vertically downward as does exterior segment 52*a* of hook 52. Therefore, due to the spacing between the slides 50, 56, leaving slot 32 between them, as well as the downward orientation of the exterior segments 42*a*, 52*b*, there is no interference between the hangers 34 and 34*b* so that they can move freely and independently forward on parallel, adjacent track members. Similarly, there is no interference between hanger 34*b* and any hanger on tracks to its right.

Another form of a hanger 34', molded of a plastic material, is shown in FIGS. 5 and 6, and includes a cross bar 36' from which a curved blade 37 depends. A vertical rib 36' adds strength to this blade. The hanger 34' has end hooks 40', 42'.

As mentioned earlier, the frame 12 is desirably removably fixed to the peg-board wall W. To this end, a pair of latches 44 are used to retain the frame 12 to the wall W. One latch is shown in plan in FIG. 4. Each latch 44 includes a central aperture 46 and when the latch 44 is utilized with the frame 12, the intermediate cross bar 20 of the frame passes through this central aperture 46. The latch 44 also includes two attaching hooks 48, 50. The hook 50, as seen in FIG. 3, defines an open slot 50*a* and is utilized to enter any aperture in a Peg-Board wall, to retain the frame 12 against the wall W. The hook 48 defines an open slot 48*a* and is used to fit into any slot contained in a vertically-disposed standard S, see FIG. 4, and by this means is able to retain the frame against a pair of standards. The shapes of the hooks 48, 50 of the latches permit easy attachment or detachment of the frame from any vertical surface having spaced openings.

The functioning of the foregoing rack supply system will be apparent from the foregoing description. A hanger 34 is placed in relationship to an article of merchandise A, so that the article of merchandise hangs on the hanger, with, usually, the bulk of the article of merchandise being situated below the hanger. A large number of hanger-article combinations are made up in this manner.

Desirably, such articles of merchandise are relatively low in cost, and would be purchased by a customer on an "impulse" basis. Typical of such articles are socks. The articles with their hangers will be loaded on a rack 10, fixed to a vertical wall. By this means, a customer walking near such a rack filled with articles, would be presented with the articles in an attractive manner, so that the customer would be tempted to pick up and purchase such an article.

When the customer desires to pick up one such article, he need merely grasp the article A, say at its band B, and lift the same upwardly, thereby completely disengaging the article and the hanger 34 from the rack 10 and its track members 24*a* and 24*b* or 24*b* and 24*c*.

Due to the downward slope of the track members 24, combined to some extent with the expected small vibration caused to the remaining articles on hangers when one article on a hanger is picked up and removed, the group of articles and hangers next in line on the slope, will slide downwardly, until the then-foremost hanger comes to the downward end of the slots 32 in the track members 24*a*, 24*b*.

By this means, a "fresh" article is presented near to a customer walking or standing in a shopping aisle. In this movement, as seen in FIG. 1, an article A and its hanger 34, would move from the full-line position shown in FIG. 1, to the dot and dash position, shown in the same figure, at the lower end of the track members.

At a later point in time, it will be desirable for employees of the retail establishment, to reload the rack 10 with additional articles. This should be done before all of the articles hanging between a pair of track members 24*a*, 24*b* have been purchased. Such employees would load new articles by placing the same with their hangers, at the higher end of the track members 24*a*, 24*b*.By such loading, the "oldest" articles would be at the lower ends of the track members, near the customer and the rack will look "full". The "newest" articles would be at the higher ends of the track members, waiting to descend as one article after another was removed by customers.

I claim:

1. A rack supply system including a frame, at least a pair of track members sloping downwardly from said frame, hangers adapted to retain articles of merchandise in hanging condition, means for slidably mounting the hangers on the track members for movement between an upper loading position and a lower dispensing position, said slidably mounting means including each hanger having ends which engage different ones of a pair of track members, means to removably fix said frame to a vertical wall, said means including a pair of latches connected to said frame, each of said latches including a pair of hooks, one hook of each latch being adapted to fit into one of a group of regularly spaced apertures in a wall and the other hook on each latch being adapted to fit into a slot in a vertical standard on a wall.

2. A rack supply system as set forth in claim 1 wherein each latch includes an aperture, a portion of the frame passing through the aperture of said latch, the latch being rotatable on said portion.

3. A rack supply system as set forth in claim 2 wherein a pair of latches is rotatable on said frame, the latches being situated on opposite sides of the frame.

4. A rack supply system to display multiple articles of merchandise, said system including a frame, means for retaining said frame in erect condition against a wall, at least three parallel track members fixed to and jutting outwardly from said frame, hangers adapted to hold the articles of merchandise and to enable them to slide along the track members, each hanger including a pair of end hooks, one hanger riding on adjacent first and second track members and the adjacent hanger riding on second and third track members, the hooks being configured so that a hanger sliding on one pair of track members clears without interference a hanger sliding on an adjacent pair of track members.

5. A rack supply system as set forth in claim 4 wherein each track member is comprised of a pair of slides, the slides of each track member between spaced apart to define a slot between them, a portion of each end hook of a hanger being inserted into a slot.

6. A rack supply system as set forth in claim 5 wherein the portions of the end hooks are oriented substantially vertically downwardly.

7. A rack supply system in combination with an array of articles of merchandise, the system including a frame, means for retaining said frame in an erect condition, at least three track members fixed to and extending outwardly from said frame, each article of merchandise including at least two similar units, means for retaining said units together, hangers adapted to hold said articles of merchandise on a pair of track members, each hanger engaging only one unit of an article of merchandise, each hanger including a pair of end hooks, each end hook engaging a a different, adjacent track member, the hangers enabling sliding movement of the articles along the track members.

8. A rack supply system as set forth in claim 7 wherein the unit retaining means comprises a band encircling the units.

9. A rack supply system as set forth in claim 8 wherein three similar units comprise an article of merchandise and the hanger engages the central unit.

* * * * *